US010543492B2

(12) United States Patent
Rhodes

(10) Patent No.: US 10,543,492 B2
(45) Date of Patent: Jan. 28, 2020

(54) METHOD AND APPARATUS FOR INTELLIGENT MAGNETIC SEPARATOR OPERATION

(71) Applicant: MAGNETIC PRODUCTS, INC., Highland, MI (US)

(72) Inventor: Keith Rhodes, Lake Leelanau, MI (US)

(73) Assignee: Magnetic Products, Inc., Highland, MI (US)

( * ) Notice: Subject to any disclaimer, the term of this patent is extended or adjusted under 35 U.S.C. 154(b) by 1 day.

(21) Appl. No.: 15/908,035

(22) Filed: Feb. 28, 2018

(65) Prior Publication Data

US 2019/0262842 A1 Aug. 29, 2019

(51) Int. Cl.
*B03C 1/28* (2006.01)
*B03C 1/0355* (2006.01)

(52) U.S. Cl.
CPC ..... *B03C 1/284* (2013.01); *B03C 1/0355* (2013.01); *B03C 1/282* (2013.01); *B03C 2201/20* (2013.01)

(58) Field of Classification Search
CPC ..... B03C 1/284; B03C 1/0355; B03C 1/282; B03C 2201/20
USPC ..... 209/214, 215
See application file for complete search history.

(56) References Cited

U.S. PATENT DOCUMENTS 2,971,703 A * 2/1961 Rath ..... B03B 9/04 241/24.14
4,402,391 A * 9/1983 Tuten ..... G07F 7/0609 177/165
4,597,487 A * 7/1986 Crosby ..... G07F 7/0609 194/209
4,784,762 A * 11/1988 Taliaferro ..... B03C 1/284 210/222
5,066,390 A 11/1991 Rhodes et al.
5,111,927 A * 5/1992 Schulze, Jr. ..... G06Q 30/02 100/902
5,413,222 A * 5/1995 Holder ..... B07C 5/344 209/567
5,541,072 A 7/1996 Wang et al.
6,085,599 A * 7/2000 Feller ..... G01F 1/60 73/861.13
6,250,475 B1 * 6/2001 Kwasniewicz ..... B03C 1/284 209/223.1
6,883,668 B1 * 4/2005 Lindsey ..... B07B 4/02 209/132

(Continued)

FOREIGN PATENT DOCUMENTS

RU 2372144 C2 11/2009

*Primary Examiner* — Terrell H Matthews
(74) *Attorney, Agent, or Firm* — Fishman Stewart PLLC

(57) ABSTRACT

A system includes a first magnetic separator, which includes a first housing or is installed in a user's first housing process system, defining a product flow path through which a material may pass, one or more magnets that generate a magnetic field that is positioned within the product flow path to attract metal from the material as the material passes through the product flow path, and a first sensor to detect a presence of captured metal contaminants on the one or more magnets, such as via a measurement of a strength of the magnetic field. The system includes a first controller configured to receive a signal from the first sensor, the signal indicating the presence of the captured metal contaminants on the one or more magnets, and send an instruction related to the signal.

26 Claims, 6 Drawing Sheets

(56) References Cited

U.S. PATENT DOCUMENTS

| | | | | |
|---|---|---|---|---|
| 6,902,066 | B2 | 6/2005 | Yang | |
| 7,216,012 | B2 * | 5/2007 | Provost | G06Q 10/107 209/584 |
| 7,631,767 | B2 * | 12/2009 | May | B03C 1/00 209/215 |
| 7,841,475 | B2 | 11/2010 | Ricardo et al. | |
| 8,132,684 | B2 | 3/2012 | Gnepper et al. | |
| 8,360,247 | B2 | 1/2013 | Baker | |
| 8,474,629 | B1 * | 7/2013 | Allore | B03C 1/284 209/223.1 |
| 8,910,795 | B2 | 12/2014 | Steele et al. | |
| 9,649,666 | B2 | 5/2017 | Gitschel | |
| 9,656,272 | B1 | 5/2017 | Richards | |
| 9,683,417 | B2 | 6/2017 | McKenzie | |
| 2003/0021524 | A1 * | 1/2003 | Dean | C08L 57/00 385/22 |
| 2008/0164183 | A1 | 7/2008 | Marston et al. | |
| 2009/0053799 | A1 | 2/2009 | Chang-Yen et al. | |
| 2013/0207496 | A1 * | 8/2013 | Garber | F16F 15/305 310/90.5 |
| 2013/0264248 | A1 | 10/2013 | Smolkin et al. | |
| 2016/0016179 | A1 * | 1/2016 | De Hoog | G03G 15/09 427/550 |
| 2016/0310962 | A1 | 10/2016 | Suderman | |
| 2017/0304845 | A1 | 10/2017 | Miles et al. | |

* cited by examiner

GAUSS GAUGE STYLE 1

GAUSS GAUGE STYLE 2

METHOD AND APPARATUS FOR INTELLIGENT MAGNETIC SEPARATOR OPERATION

TECHNICAL FIELD

This disclosure relates generally to a magnetic separator to remove ferrous and paramagnetic materials from non-ferrous materials, and more specifically to a method and apparatus for intelligent magnetic separator operation.

BACKGROUND

Since first introduced in the latter part of the 1800's as "electromagnets" and more commonly since the 1930's to present as "permanent magnets", magnetic separators have been used to improve product quality of non-ferrous materials and to protect process machinery from damage caused by unwanted metals (metal contaminants) being commingled with non-ferrous materials during the manufacturing and/or product refinement process. Unwanted or commingled ferrous metals and non-ferrous materials can also pose a safety hazard where combustible materials such as wood, grains or other similar materials are being handled. For these reasons it is imperative that a magnetic separator is used to remove unwanted metal contaminants.

Maintaining and improving non-ferrous materials product quality use a variety of methods. Known methods can be as informal as simply removing captured metal contaminants from a magnetic separator when found during periodic or random manual inspections of the magnetic separator, to highly structured and documented quality control processes adopted by the user as part of their materials manufacturing process. These more structured methods include but are not limited to Hazard Analysis Critical Control Points (HACCP), Total Quality Manufacturing (TQM), Good Manufacturing Processes (GMP), to name a few. These more formal methods directed towards product quality are internationally recognized and are accepted processes by global governmental agencies such as the United States Food and Drug Administration (FDA), Food Safety Modernization Act (FSMA), Global Food Safety Initiative (GFSI), International Organization for Standardization (ISO), British Retail Consortium (BRC), Safe Quality Food (SQF), to name a few. To ensure these formal quality standards are constantly maintained in production facilities, they are often monitored not only by internal quality control staff, but include third party outside auditing and certification.

Also, since the development of permanent magnets, the electromagnet has had a somewhat limited role as a viable solution when selecting a magnetic separator. One exception of where electromagnets are desired over permanent magnets is when very large magnets are used to project effective magnetic fields at great distances from the magnetic separator. Commonly, these applications are found in minerals mining and recycling materials process, to name a few. Otherwise, permanent magnets are often the preferred choice, due to a few primary reasons.

First, an electromagnet is typically much larger than a comparable permanent magnet for a specific application. Because of its superior magnetic strength, a permanent magnet is typically more effective in capturing unwanted metal contaminants when compared to a similar sized electromagnet. Because the permanent magnet does not require electricity or a controller to operate, it is often less expensive to manufacture and more reliable than an electromagnet.

Since the inception of newer more powerful ferrite and rare earth permanent magnets, permanent magnets are capable of effectively capturing metals that electromagnets may not be able to capture.

When magnetic separators are used in a process as discussed herein, one important purpose of the magnetic separator is to remove metals from non-ferrous materials that are being processed. This is accomplished by placing magnets of a magnetic separator in proximity to the materials being processed so that any metal contaminants are captured and held by the magnets as the materials being processed either make intimate contact with the magnets' working surface, or pass through the magnets' working air gap. Once the metals have been captured by the magnets, and before oncoming non-ferrous material stream flows are able to wipe off or otherwise re-commingle the metals back into the non-ferrous materials, they are removed from the magnets using the magnetic separator. Depending on the type of magnetic separator used, the captured metals removal function is accomplished either manually or automatically (continuously or intermittently) for final disposition and disposal.

It is known that a magnetic separator's ability to capture unwanted metals may be compromised when captured metals are not removed from the magnets in a timely manner. Thus, a magnetic separator that has captured metals on it may thereby have a reduced gauss level. Thus, if any contaminating materials are not timely removed, this condition can often result in the captured metals becoming re-commingled with the non-ferrous materials. This can occur more commonly where manually cleaned magnetic separators are deployed. Thus, due to the needed human interaction to complete the magnet particle removal (or, referred to generally as magnet cleaning), and due to the common difficulties that can be encountered when removing captured metals from powerful permanent magnets, magnetic separators may not be cleaned in a timely manner. This can result in metals becoming re-commingled with the non-ferrous materials, thereby compromising if not fully negating the magnets' ability to perform their designed function. Manually cleaned magnetic separators often offer a more affordable design, but include the limitations as noted above.

In an alternative to the more affordable manually cleaned magnetic separators, another option is to utilize an automatically cleaned magnetic separator. Depending on the application where the magnetic separator is to be used, an automatically cleaned magnetic separator may be a valid alternative. This can be continuously cleaned magnets where the captured metals are immediately removed from the magnets, or an intermittent automatically cleaned magnetic separator where the captured metals are removed on a pre-determined cycle period based on user preference. Either design method is typically more expensive than a manually cleaned magnetic separator and is therefore often not considered as an affordable option.

The continuously cleaned magnetic separators offer some limited design options that are often not practical for many applications where magnetic separators are desired in a process. Additionally, they are typically more expensive and, depending on the severity of metals commingled with the non-ferrous materials being processed, may not justify the extra expense for this style of magnetic separator.

The intermittently cleaned magnetic separators offer more design options as compared to continuous clean magnetic separators. Disadvantages with these designs, however, are at least twofold. Like continuously cleaned magnetic separators, intermittently cleaned magnetic separators are typically more expensive. Additionally, because their automatic metal contaminant removal feature is intermittent, captured metals can be washed off the magnets by oncoming non-ferrous materials flowing past the magnets between cleaning cycles.

In addition, continuously cleaned and intermittently cleaned magnetic separators, having their cleaning cycles initiated using a predetermined cycle, may also therefore result in needless cleaning. That is, for periods during light use or no use, the cleaning cycle may nevertheless be initiated on its intermittent basis, which can cause unnecessary cost and wear.

Thus, there is a need to improve magnetic separators while reducing overall cost of operation.

BRIEF DESCRIPTION

The disclosed subject matter is directed generally toward a magnetic separator to remove ferrous and paramagnetic materials from non-ferrous materials, and more specifically to a method and apparatus for intelligent magnetic separator operation According to the disclosure, a system includes a first magnetic separator, which includes a first housing or is installed in a user's first housing process system, defining a product flow path through which a material may pass, one or more magnets that generate a magnetic field that is positioned within the product flow path to attract metal from the material as the material passes through the product flow path, and a first sensor to detect a presence of captured metal contaminants on the one or more magnets, such as via a measurement of a strength of the magnetic field. The system includes a first controller configured to receive a signal from the first sensor, the signal indicating the presence of the captured metal contaminants on the one or more magnets, and send an instruction related to the signal.

Also, according to the disclosure, a method of monitoring magnetic separators that includes generating a magnetic field in a product flow path using one or more magnets, the product flow path defined by a chute or a first housing through which a material may pass, detecting a presence of captured metal contaminants on the one or more magnets, and sending an instruction related to the detected presence of the captured metal contaminants.

Disclosed also is a magnetic separator that includes a first housing defining a product flow path through which a material may pass, magnets that generate a magnetic field that is positioned within the product flow path to attract metal from the material as the material passes past the magnets, a sensor to detect a strength of the magnetic field in a working air gap that is between the magnets, and a controller configured to receive a signal from the sensor, the signal indicating the strength of the magnetic field, detect a change in the strength of the magnetic field, and send an instruction related to the change.

Various other features and advantages will be made apparent from the following detailed description and the drawings.

DETAILED DESCRIPTION

Figure 1:
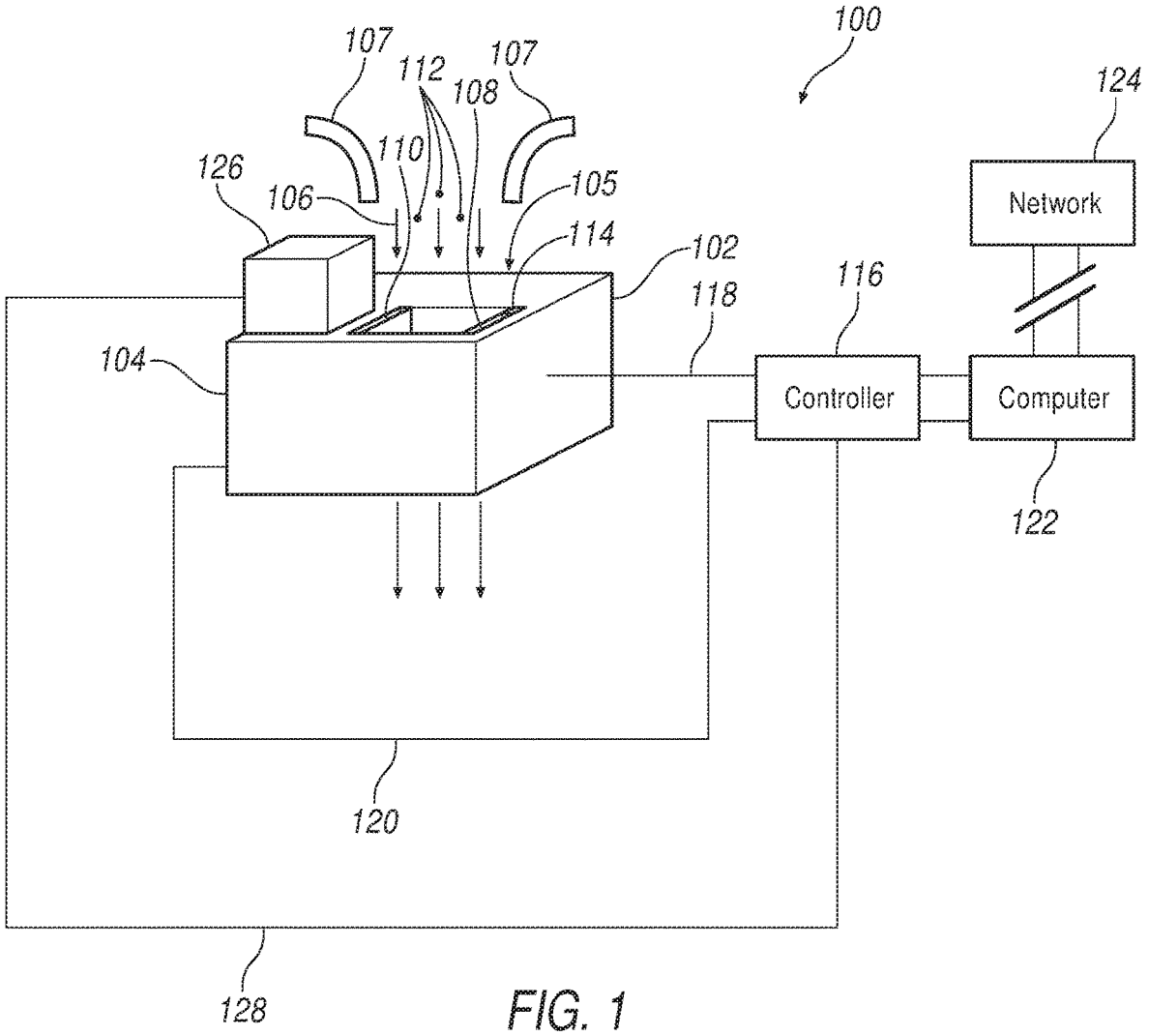
FIG. 1 is a system that includes a magnetic separator, according to the disclosure.

The operating environment of disclosed embodiments is described with respect to intelligent magnetic separator operation.

As indicated, metal contaminants when commingled with non-ferrous materials pose a significant detriment to product quality while also creating a potential hazard in the manufacturing process of these materials. Users of magnetic separators are continuously working to improve production throughput while also producing products with ever increasing quality.

A magnetic separator is designed to accomplish at least two tasks. First, it captures unwanted metal contaminants from commingled non-ferrous materials. Second, it is cleaned before these captured metal contaminants re-commingle with the non-ferrous materials.

The current disclosure addresses these two objectives in a much more effective manner than in known systems. The disclosed system and method combines the magnetic strength of a magnetic separator with the technology of an automatic intermittent cleaning capability, and the additional ability to monitor the change in the magnets' strength. The disclosed magnetic separator enables a user to place a magnetic separator into a non-ferrous materials process where the magnetic separator has the intelligence or capability to know or convey when it needs to be cleaned of captured metal contaminants. Cleaning takes place before the captured metal contaminants can be washed off the magnets by oncoming non-ferrous materials flowing past the magnetic separator, and before the magnets' field strength is reduced to an ineffective level from excessive buildup of captured metal contaminants on the magnets' working surface.

Whether the magnetic separator is designed to capture unwanted metal contaminants from intimate contact on the magnets' surfaces or as they pass through the magnets' working air gap, or both, the disclosed system continuously monitors the magnets' external gauss levels where metals are captured. As the magnets capture and retain these metal contaminants and they become magnetized, the effectiveness of the magnets' field strength is reduced. Change in the magnets' field strength effectiveness can be measured in gauss. The disclosed system monitors this change in gauss level and sends an electronic signal to the magnets' automatic cleaning apparatus. Thus, the metal contaminants are removed from the magnets as quickly and as necessary to maintain optimum operating performance without the need for any human interaction.

The disclosed intelligent magnet system is not limited to only automatic cleaning magnetic separators. Rather, manually cleaned magnetic separators may also benefit, as well. The intelligent magnet system can send an electronic signal to a remote monitoring location and/or activate a mechanical device on the magnets or near their location in a more visible area to alert the need for the magnets to be cleaned of unwanted metal contaminants. A user or maintenance person may then initiate a cleaning procedure of the manually cleaned system.

Permanent magnetic separators include various materials that may include an external non-ferrous housing such as stainless steel, mild steel to concentrate and direct the flux patterns of the magnet's magnetic circuit, and permanent magnet material most commonly from ferrite or rare earth magnetic materials. The combination of these materials creates an external magnetic field that captures and holds metal contaminants to separate and remove them from commingled non-ferrous materials. In some examples, magnetic separators may not include a separate housing, but may instead have one or more magnets applied to a product flow path of an existing product flow path (such as a chute through which product flows, and magnets separators may be attached thereto, to capture ferromagnetic particles within product passing through the product flow path.)

Electromagnets are similar to permanent magnets in how they are made. One difference is, however, instead of using a permanent magnet material to create its magnetic field, electromagnets use a wound coil (or series of wound coils) and electronic controller. Thus, both permanent and electromagnet type magnetic separators are known and used, although the electromagnet type includes additional electrical components to affect the magnetic field.

Depending on the design and structure of the magnetic separator's magnetic circuit, metal contaminants from weakly magnetic fines to large metal objects can be captured. Based on the magnetic separator's design, this is accomplished from making intimate contact on the magnetic separator's external surface, or at greater distances from the magnets' surfaces within a pre-defined working air gap where the magnetic materials are drawn toward and ultimately in intimate contact with the magnets, or with magnetic contaminant buildup on the magnets. Metal contaminants are attracted to the magnets when they become saturated by the magnets' flux protruding from the magnetic separator's external surface (i.e., a working air gap). Another factor to consider on how metal contaminants are attracted to and held by a magnetic separator is the change in gauss when measured at a distance from the magnets' external surface (the magnet's gradient). The level of magnetic gauss in the magnets' working air gap to their external surfaces will improve the magnets' ability to capture and retain metal contaminants as gauss (line of flux) is increased.

Because a magnetic separator's magnetic field strength is essentially static once the magnetic separator has been designed and manufactured, the magnets' circuit can be measured and profiled. From this data, the original magnetic circuit of the magnetic separator can be established as the strongest or optimum profile for the subject magnetic separator. According to the disclosure, by placing a gauss measurement device such as a Hall effect sensor within the magnetic separator, the defined magnetic circuit profile can be measured and monitored. And, it is further contemplated that other sensors such as a laser sensor or a proximity (i.e., non-magnetic) sensor could be applied to detect materials on the magnets, according to the disclosure.

As the magnetic separator's gauss profile changes, which is caused by increasing accumulations of metal contaminants on the magnet's external surface, these changes are measured, according to the disclosure. In the case of an electromagnetic separator, should the unit's coil winding become damaged or diminished over time, the change in gauss profile can inform the user to take corrective action. As the gauss profile is diminished or reduced based on Hall effect sensor pre-sets, the magnetic separator can signal the need for magnet cleaning. Likewise, monitoring the gauss profile for a permanent magnet or electromagnet design can also reveal if damage may have occurred to the magnetic separator. Thus, according to the disclosure, not only can a need for cleaning be detected, overall system performance can be monitored as well.

In the instance of an automatic cleaning magnetic separator the magnet cleaning function can be accomplished with virtually no need for human interaction. In the instance of a manually cleaned magnetic separator, the disclosed system can signal the need for magnet cleaning to an operator assigned to remove captured metals from the magnetic separator. In both instances, all data relating to the optimum and changing gauss profile of the magnetic separator, and the time and intervals the magnetic separator has been cleaned of captured metal contaminants is documented in real time.

This data can be compiled locally at the production facility or sent to remote locations and/or third-party auditors as defined by the user. This capability significantly improves the magnetic separator's overall effectiveness to capture and remove metal contaminants from non-ferrous materials during processing while also providing full automation of the magnet cleaning schedule on an as needed basis without the need for human interaction. Because this activity is monitored and recorded in real time, the disclosed system also provides the added benefit of addressing requirements as defined by the user to meet even the most sophisticated quality control program. These benefits provide improved magnetic separator performance and quality control documentation, which can be freely and readily compiled and provided to users.

The disclosed intelligent magnetic separator constantly monitors the magnets' field strength using electronic measurement to monitor the magnet's gauss levels. This provides the ability to remove captured metal contaminants as required to optimize the magnets' performance while also reporting the magnets' changes in field strength in real time. This information is easily documented and disseminated both locally at the production facility and remote locations such as a company's headquarters, or to a third-party auditor when desired. As non-ferrous materials quality control processes in manufacturing have improved as noted above, so has the need for better performing and more reliable performance of magnetic separators. The disclosed intelligent system provides this improved metal contaminants capture and documentation in real time.

Referring to FIG. 1, system 100 includes a first magnetic separator 102 that includes, in one example, a first housing 104 defining a product flow path 105 through which a material 106 may pass. The material passing through product flow path 105 may be solid materials or liquid, as examples. In lieu of or in addition to first housing 104, system 100 may include a chute or other passageway 107 through which product may flow, and to product flow path 105. Chute or passageway 107 may include, in one example, an existing product flow path in a facility through which product flows, and to which components of the disclosed system are attached. System 100 includes one or more magnets 108, 110 that generate a magnetic field that is positioned within product flow path 105 to attract metal 112 from material 106 as material 106 passes through product flow path 105. Thus, captured metal contaminants or metal 112, according to the disclosure, represents any material that may be attracted or repelled, as is the case in an eddy current separator, due to the presence of a magnetic field. The one or more magnets 108, 110 may be permanent magnets, or may be electromagnets that are powered using an external power supply such as a controller. System 100 includes a first sensor 114 to detect a strength of the magnetic field, and a first controller 116 configured to receive a signal from first sensor 114, the signal indicating the strength of the magnetic field, and configured to detect a change in the strength of the magnetic field, and send an instruction related to the change. That is, an instruction may be sent indicating that a measured gauss field has reduced, due to the presence of magnetic contaminants, and the magnetic contaminants must be removed, or 'cleaned' from the magnets, to restore the magnet field strength to magnets 108, 110. Leads 118, 120 extend from controller 116 respectively to magnets 108, 110. Leads 118, 120 may be connected to sensors, such as Hall Effect Sensors, and/or to magnets 108, 110 such that electrical current may be carried thereto (in an example where magnets 108, 110 are electromagnets) to provide power to magnets 108, 110. However, it is contemplated that wireless sensors may also be applied, in which case leads 118, 120 would not be required. Further, it is contemplated, according to the disclosure, that sensors other than magnetically-based sensors may be employed. For instance, a laser, radar, or proximity sensor may be used, as examples, to detect a presence of materials captured on magnets 108, 110. Accordingly, and according to the disclosure, first sensor 114 may be any sensor that can detect the presence of captured metal contaminants. Controller 116 is connected to a computer 122, which in one example is further connected to a network 124.

System 100 further includes a device for restoring the magnetic field strength by removing metallic contaminants or particles, referred to generally as self-cleaning device 126. Self-cleaning device 126 may include any cleaning implement that may be separately or remotely controlled via controller 116 and via a connection lead 128. In such fashion, self-cleaning device 126 may be remotely or automatically activated to clean debris (whether magnetic, or not) from surfaces of magnets 108, 110. It is contemplated that activation of any self-cleaning mechanism may be in conjunction with a control of magnetic field strength in magnets 108, 110. Thus, in an example where magnets 108, 110 are electromagnets, activation of self-cleaning device 126 may, concurrently, include de-powering or de-magnetization of magnets 108, 110. That is, power from controller 116 may be reduced or entirely shut off, such that any magnetic debris captured by magnets 108, 110 may be allowed to wipe or clean freely from the surfaces of magnets 108, 110. Further, in one respect non-magnetic materials may also be adhered to the surfaces of magnets 108, 110, or otherwise captured by any magnetic debris that may magnetically attracted to magnets 108, 110. As such, cleaning of magnets 108, 110 may include not only reducing any power to magnets 108, 110, but also vigorously cleaning or scrubbing of the surfaces of magnets 108, 110 via self-cleaning device 126. Self-cleaning device 126 is shown in a block-diagram representation, but it is contemplated that self-cleaning device 126 represents any cleaning device such as a liquid or solvent spray or a mechanical scrubbing device. That is, self-cleaning device 126 may be any self-cleaning device, as known in the industry, that may be used to automatically clean magnets 108, 110 and within an air gap between magnets 108, 110. Self-cleaning device 126 may thereby be any device that may be used to clean magnets 108, 110, and particularly the surfaces thereof as further described herein.

In one example, system 100 does not include self-cleaning device 126. Such an example may itself include electromagnets, or permanent magnets, as magnets 108, 110. In this example, rather than activating any self-cleaning operation of self-cleaning device 126, a signal may be sent out via, for instance, computer 122 and via network 124, such that a user may manually clean magnets 108, 110. As will be further described, computer 122 and network 124 may be contained within one facility, such as a food or other material processing plant, or computer 122 may be part of a much larger and interconnected array of magnetic separators via network 124.

Figure 2A:
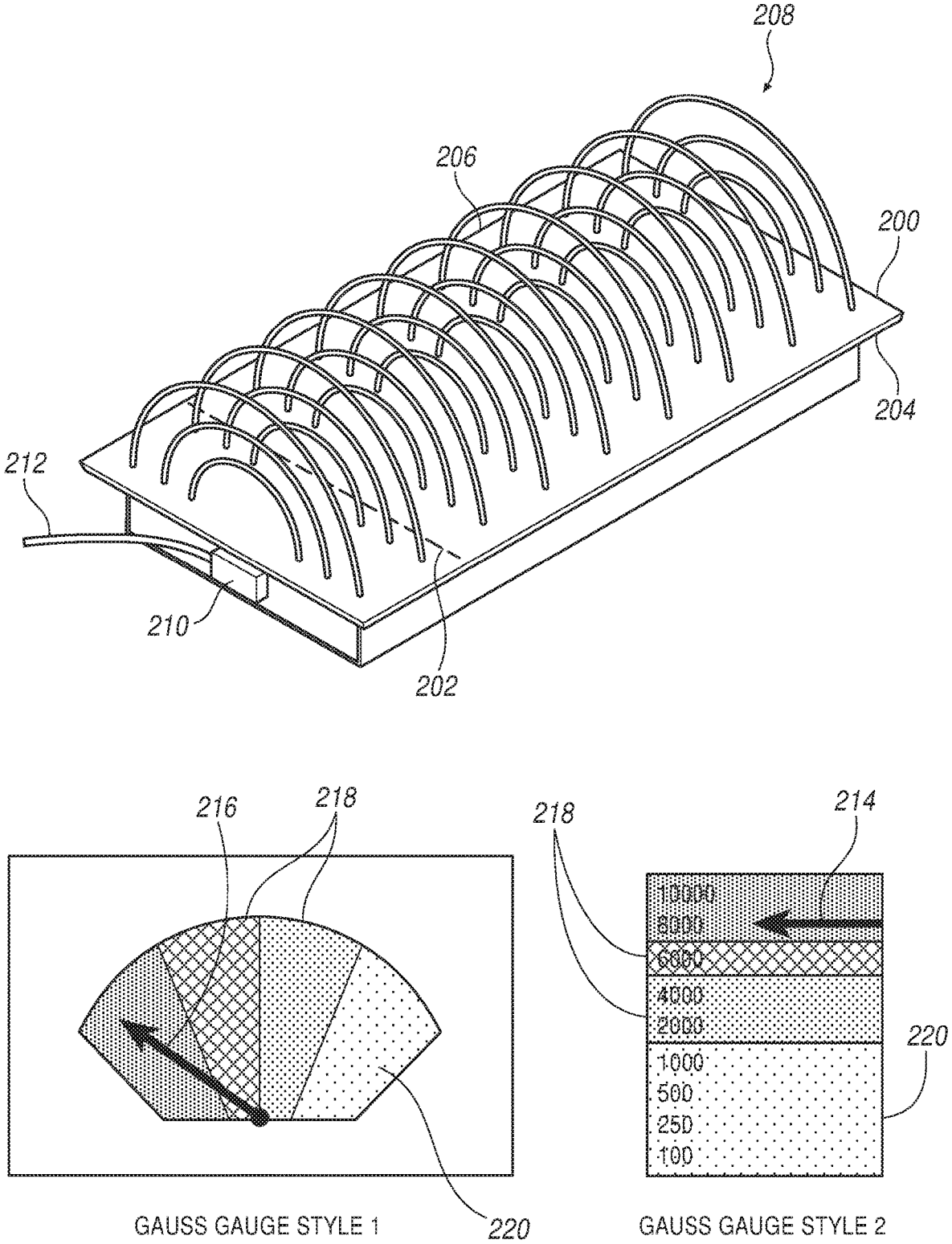
FIG. 2A illustrates a magnet having its magnetic fields illustrated, but in an unencumbered fashion.
Figure 2B:
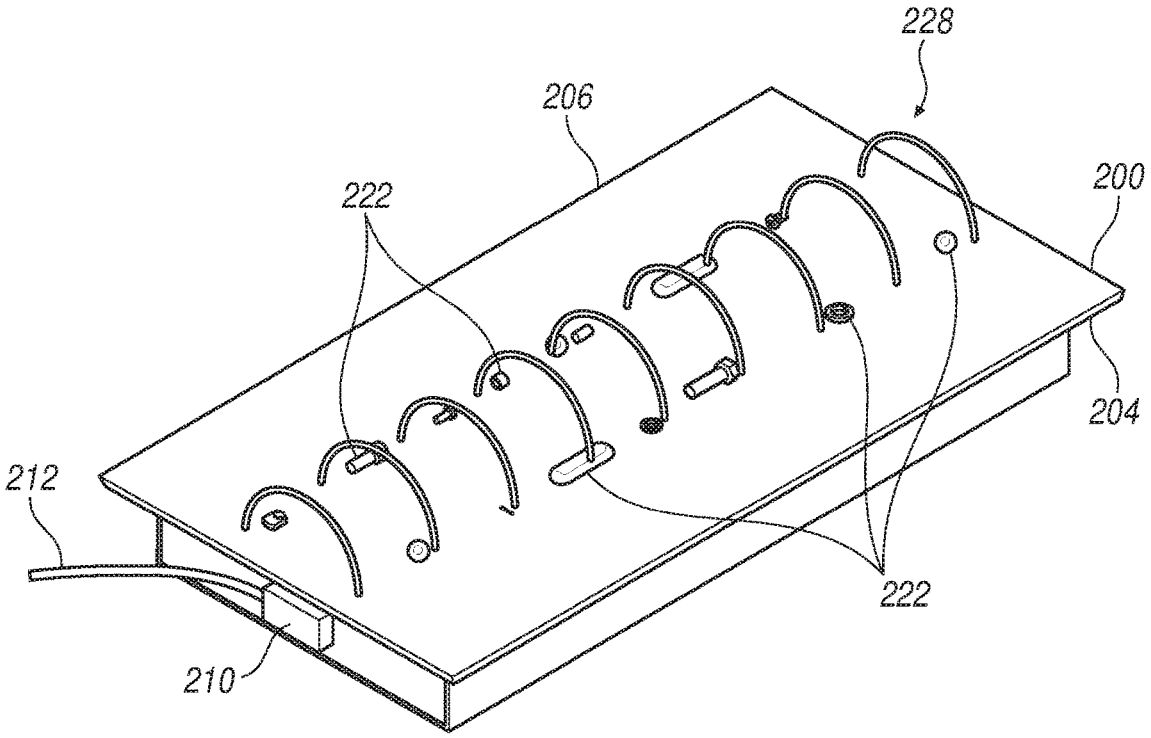
FIG. 2B illustrates the magnet of FIG. 2A, but having encumbered magnetic fields shown, which are reduced due to the presence of metal contaminants.
Figure 2B:
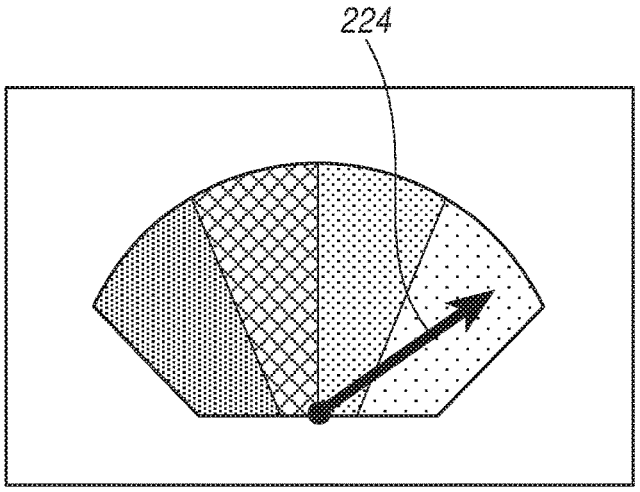
Figure 2B:
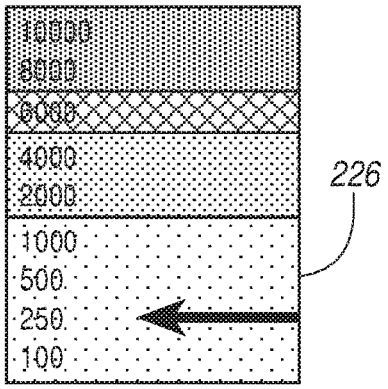

FIG. 2A illustrates a magnet having its magnetic fields illustrated, but in an unencumbered fashion. FIG. 2B illustrates the magnet of FIG. 2A, but having encumbered magnetic fields shown, which are reduced due to the presence of metal contaminants.

Referring to FIGS. 2A and 2B, a magnet 200 is illustrated, which corresponds generally to one of magnets 108, 110 of FIG. 1. As shown in FIG. 1, system 100 includes two magnets 108, 110, however it is contemplated that only one magnet may be included in system 100, or that system 100 may include multiple magnets. As seen in FIG. 2A, magnet 200 may be a single plate (as shown) or may be multiple plates (such as a plurality of magnets lined up side-by-side, as illustrated in one example as an optional break 202 along the illustrated plane). In fact, magnet 200 (and correspondingly magnets 108, 110 of FIG. 1) may be any type of magnet system, such as one or more magnetic tubes, cleaned according to the disclosure. Thus, any design of a magnetic separator may be cleaned. That is, depending on the magnet style, there may be a single or plurality of cylindrical or other shaped magnets, and not always a flat plate, that may be cleaned. In addition, the cleaning may be by any means, such as via a drawer magnet cleaning system (wherein magnets are contained in a drawer style configuration). Thus, in this example, cleaning may be performed by automatically withdrawing and then returning a box that contains one or a plurality of magnets, represented generally as self-cleaning device 126 in FIG. 1. Other self-cleaning devices are contemplated as well, such as for automatic cleaning of systems used in magnetic filtration devices, as another example. In the illustrated example, magnet 200 is planar in nature and includes polarities having a north polarity 204 and a south polarity 206. Accordingly, a magnetic field 208 is generated between north and south polarities 204, 206. And, as described above, magnet 200 may be one or more electromagnets powered by multiple leads (not shown), or magnet 200 may be a permanent magnet that generates a magnetic field. Permanent magnets may be from an object made from a material that is subsequently magnetized to create its own persistent magnetic field (such as a ferromagnet). Such magnets may be made from iron, nickel, cobalt, or alloys of ferromagnetic or rare-earth metals, to name a few. An electromagnet is made from a coil of wire that acts as a magnet when an electric current passes through it but stops being a magnet when the current stops.

Referring to FIG. 2A, and having magnet 200 positioned as one of magnets 108, 110, it is evident that magnetic field 208 projects into product flow path 105. As such, material 106 passing through product flow path 105, and any metal particles or other materials, such as metal 112, will be attracted toward magnet 200.

Magnet 200 includes a sensor 210 having a lead 212 extending therefrom. As indicated in FIG. 2A, magnet 200 includes a clean or uncontaminated surface, and therefore a maximum magnetic field strength, or measured gauss 214, 216, measured by sensor 210. That is, the measured gauss or magnetic strength may be indicated as a numerical value 214, or via an arrow 216. In either view or representation, lesser gauss readings 218 may be represented as corresponding to a reduced magnetic field strength, and a minimal field strength 220 may be experienced. Thus, according to the disclosure, sensor 210 is positioned proximate a working air gap, such as product flow path 105, that is between magnets 108, 110.

Depending on the needs of the system, a threshold gauss level may be established, below which corrective action must be taken. For instance, in a system that includes electromagnets, it is contemplated that additional field strength may be provided to generate a higher or increased gauss level. Thus, in one example the corrective action may be to apply a greater field strength (or greater duty cycle, if operating at less than 100%), or a second electrical current, to magnets 108, 110, via controller 116. However, in some systems the gauss level may not be increased, either because controller 116 is already providing sufficient or maximum current, or because magnets 108, 110 are operating at their maximum. Thus, in some examples, corrective action may include implementing a self-cleaning operation via self-cleaning device 126. As described, such action may concurrently include powering down magnets 108, 110, to ease cleaning of magnets 108, 110. And, in a system that does not include self-cleaning, such as self-cleaning device 126, such corrective action may include sending out a message or instruction to, for instance, a user or to maintenance personnel, indicating that the gauss level has become unacceptably low, so that the unit may be cleaned. That is, the corrective action may include an instruction sent indicating that the first magnetic separator will require cleaning.

Referring to FIG. 2B, as an example, magnet 200 includes ferrous metal contaminants or captured metal contaminants 222, which interfere or interrupt the magnetic field generated by magnet 200. FIG. 2B represents an example having sufficient ferrous metal contaminants present, to the point where insufficient magnetic field is generated by magnet 200 (positioned as magnets 108, 110 in FIG. 1) and within product flow path 105. The low gauss reading is illustrated at optional locations 224, 226 and visually illustrated as a reduced gaussian field 228. Such contrasts with magnetic field 208 illustrated in FIG. 2A.

Accordingly, FIG. 2B represents an example where corrective action must be taken, as gauss field 228 is insufficient to properly capture metals 112 as they pass through product flow path 105. That is, if no further corrective action is taken, then metals 112 may pass through product flow path 105 and remain within material 106, even after passing magnets 108, 110.

Figure 3A:
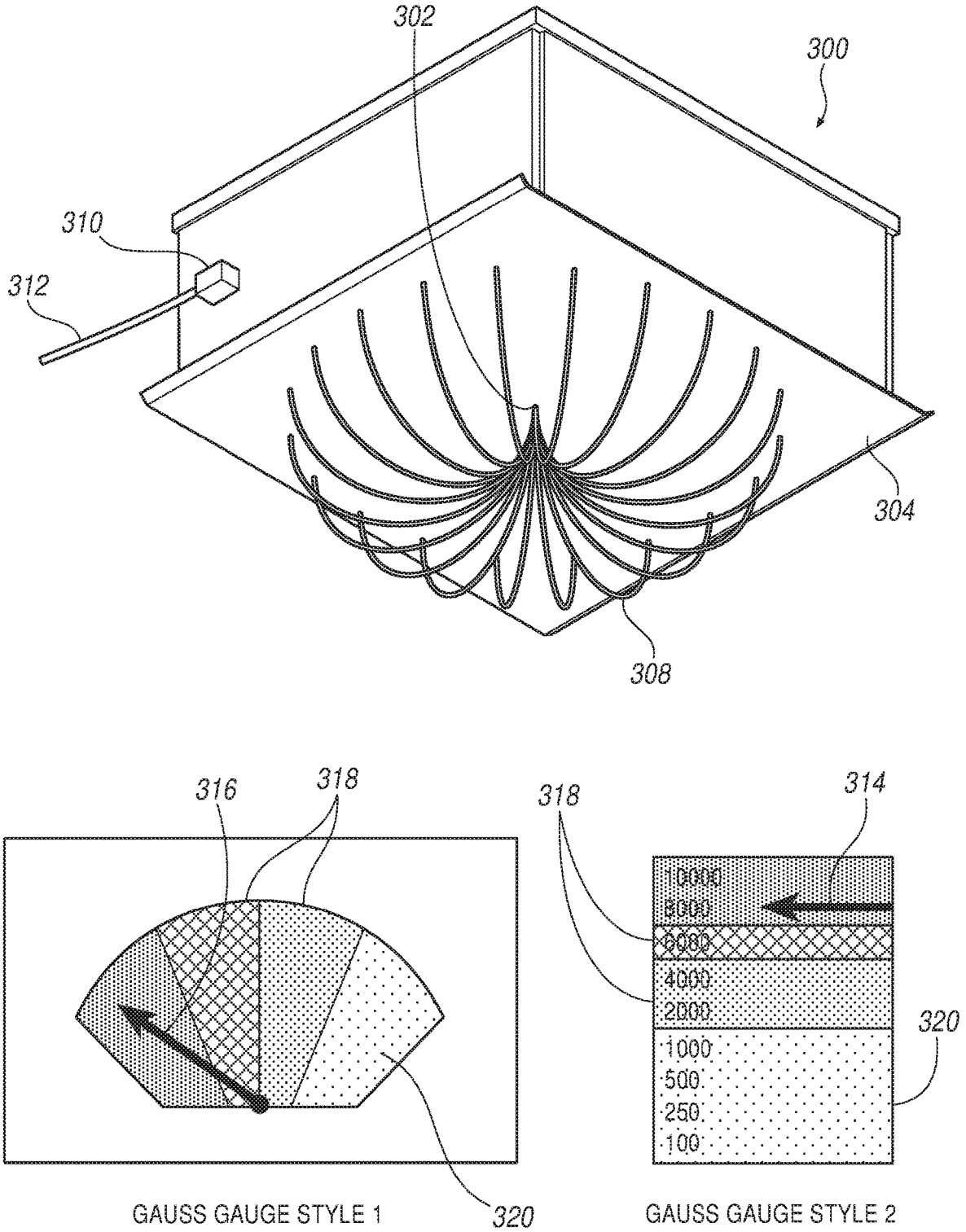
FIG. 3A illustrates a magnet having its magnetic fields illustrated, but in an unencumbered fashion.
Figure 3B:
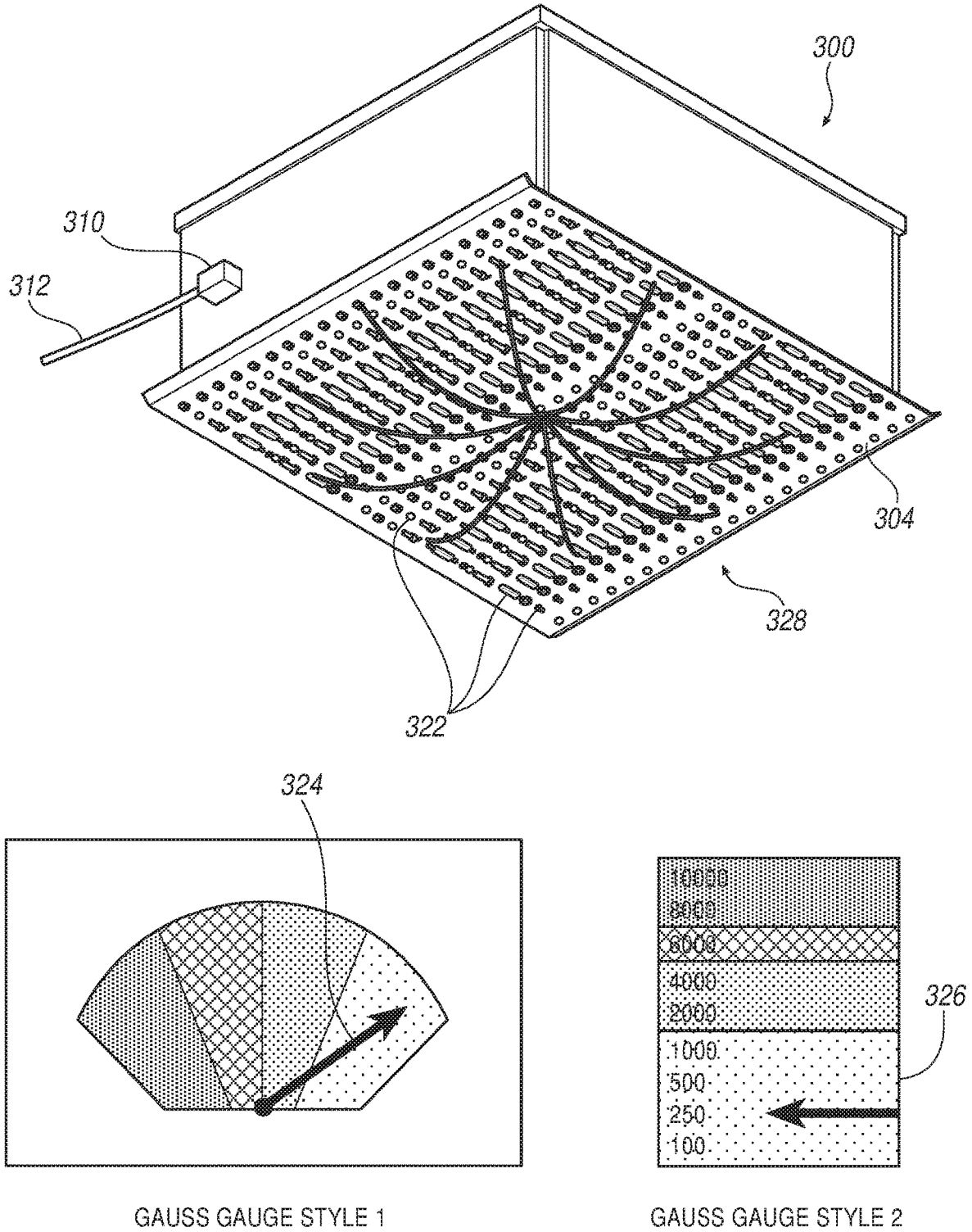
FIG. 3B illustrates the magnet of FIG. 3A, but having encumbered magnetic fields shown, which are reduced due to the presence of metal contaminants.

FIG. 3A illustrates a magnet having its magnetic fields illustrated, but in an unencumbered fashion, and according to another example. FIG. 3B illustrates the magnet of FIG. 3A, but having encumbered magnetic fields shown, which are reduced due to the presence of metal contaminants.

Referring to FIGS. 3A and 3B, a magnet 300 is illustrated, which corresponds generally to one of magnets 108, 110 of FIG. 1. As seen in FIG. 3A, magnet 300 may be a single plate (as shown), and may include one of its magnetic poles in a center 302 of magnet 300. In the illustrated example, magnet 300 is planar in nature and includes polarities having north and south polarities (one at the center 302, and the other about a perimeter 304). Accordingly, a magnetic field 308 is generated between north and south polarities. And, as described above, magnet 300 may be one or more electromagnets powered by multiple leads (not shown), or magnet 300 may be a permanent magnet that generates a magnetic field, as described above.

Referring again to FIG. 1, and having magnet 300 positioned as one of magnets 108, 110, it is evident that magnetic field 308 projects into product flow path 105. As such, material 106 passing through product flow path 105, and any metal particles or other materials, such as metal 112, will be attracted toward magnet 300.

Magnet 300 includes a sensor 310 having a lead 312 extending therefrom. As indicated in FIG. 3A, magnet 300 includes a clean surface, and therefore a maximum magnetic field strength, or measured gauss 314, 316, measured by sensor 310. That is, the measured gauss or magnetic strength may be indicated as a numerical value 314, or via an arrow 316. In either view or representation, lesser gauss readings 318 may be represented as corresponding to a reduced magnetic field strength, and a minimal field strength 320 may be experienced. Thus, according to the disclosure, sensor 310 is positioned proximate a working air gap, such as product flow path 105, that is between magnets 108, 110.

As with FIGS. 2A and 2B, depending on the needs of the system, a threshold gauss level may be established, below which corrective action must be taken. For instance, in a system that includes electromagnets, it is contemplated that additional field strength may be provided to generate a higher or increased gauss level. Thus, in one example the corrective action may be to apply a greater field strength, or s second electrical current, to magnets 108, 110, via controller 116. However, in some systems the gauss level may not be increased, either because controller 116 is already providing sufficient or maximum current, or because magnets 108, 110 are operating at their maximum. Thus, in some examples, corrective action may include implementing a self-cleaning operation via self-cleaning device 126. As described, such action may concurrently include powering down magnets 108, 110, to ease cleaning of magnets 108, 110. And, in a system that does not include self-cleaning, such as self-cleaning device 126, such corrective action may include sending out a message or instruction to, for instance, a user or to maintenance personnel, so that the unit may be cleaned. That is, the corrective action may include an instruction sent indicating that the first magnetic separator will require cleaning.

Referring to FIG. 3B, as an example, magnet 300 includes ferrous metal contaminants or captured metal contaminants 322, which interfere or interrupt the magnetic field generated by magnet 300. FIG. 3B represents an example having sufficient ferrous metal contaminants present, to the point where insufficient magnetic field is generated by magnet 300 (positioned as magnets 108, 110 in FIG. 1) and within product flow path 105. The low gauss reading is illustrated at optional locations 324, 326 and visually illustrated as a reduced gaussian field 328. Such contrasts with magnetic field 308 illustrated in FIG. 3A.

Accordingly, FIG. 3B represents an example where corrective action must be taken, as gauss field 328 is insufficient to properly capture metals 112 as they pass through product flow path 105. That is, if no further corrective action is taken, then metals 112 may pass through product flow path 105 and remain within material 106, even after passing magnets 108, 110.

Thus, disclosed also is a method of monitoring one or more magnetic separators 102 that includes generating a magnetic field 208, 228 in product flow path 105, the product flow path 105 defined by first housing 102 through which material 106 may pass, detecting a change in a strength of the magnetic field (i.e., between an uncontaminated magnetic field strength and one contaminated), and sending an instruction related to the change.

Figure 4:
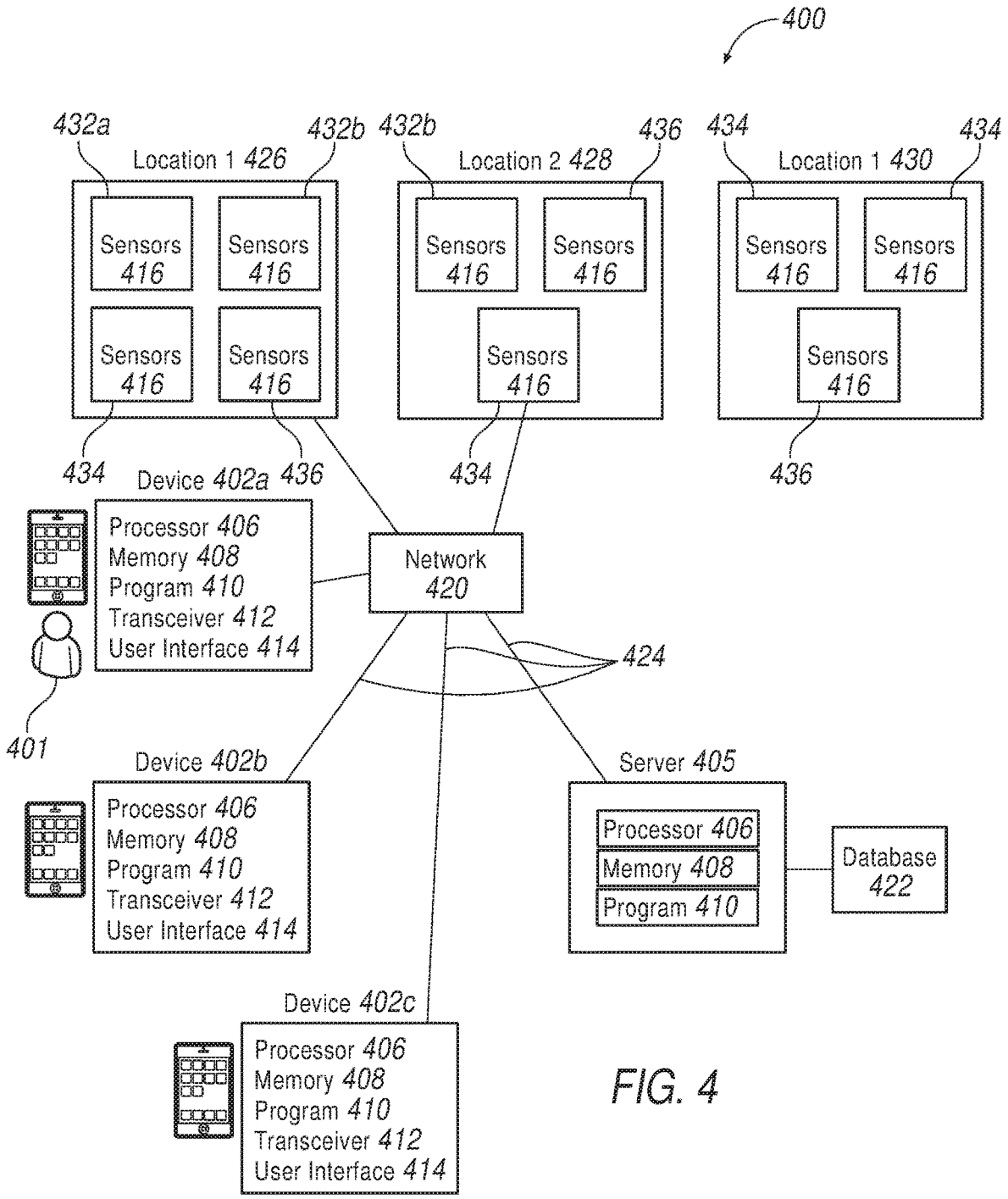
FIG. 4 illustrates an exemplary system of magnetic separators that are interconnected via a network.

FIG. 4 illustrates an exemplary system of magnetic separators that are interconnected via a network. Referring to FIG. 4, magnetic separators are may be operated in shops or facilities globally and may vary from location to location. For instance, some magnetic separators include self-cleaning devices, which others require manual cleaning.

Further, various releases of the same model magnetic separator itself can result in a varied operation. That is, a magnetic separator may be upgraded to a new model having, for instance, a different cleaning system or a different type of gauss sensor, as examples. Or, a given model itself may be sold having upgraded control software with new settings, compared to a previous model.

Disclosed is an exemplary system that may include a network of magnetic separators that provide data usage for various types of magnetic separators, under various conditions of usage, and for varying types of applications. According to one example, and generally according to the disclosure, the term 'system' may refer to several magnetic separators, or to just one magnetic separator. The disclosed system expedites a learning process to account for the above factors so that experience or best practices learned at one location, or for a given set of conditions, may be carried forth to another location or to another set of conditions, to account for the variances experienced. The disclosed system also provides feedback to a manufacturer so that new firmware may be written to improve process controls, or so that hardware may be upgraded based on usage in myriad different locations and conditions. The disclosed system also provides feedback so that setting upgrades may also be implemented, as well. Overall, the disclosed system and method heuristically employs best practices by accumulating statistical data and information related to operation of magnetic separators in various locations.

FIG. 4 illustrates an exemplary system 400, for example, to generate and communicate magnetic separator usage information based on usage at various locations, under different conditions, magnetic separator types, and applications, using for instance a WIFI system. System 400 may take many different forms and include multiple and/or hardware components and facilities. While an exemplary system 400 is shown in FIG. 4, the exemplary components illustrated are not intended to be limiting, may be optional, and are not essential to any other component or portion of system 400. Indeed, additional or alternative components and/or implementations may be used.

System 400 may include or be configured to be utilized by a user 401 such as an engineer, statistician, or data processing technician. System 400 may include one or more of computing devices 402*a*, 402*b*, 402*c*, server 405, processor 406, memory 408, program 410, transceiver 412, user interface 414, sensors 416, network 420, database 422, and connections 424. Device 402 may include any or all of device 402*a* (e.g., a desktop, laptop, or tablet computer), device 402*b* (e.g., a mobile or cellular phone), and device 402*c* (e.g., a mobile or cellular phone). Processor 406 may include a hardware processor that executes program 410 to provide any or all the operations described herein (e.g., by devices 402*a*, 402*b*, 402*c*, server 405, database 422, or any combination thereof) and that are stored as instructions on memory 408 (e.g., of device 402*a*, 402*b*, 402*c*, server 405, or any combination thereof).

An exemplary system 400 may include user interface 414, processor 406, and memory 408 having program 410 communicatively connected to processor 406. System 400 may further include transceiver 412 that may be communicatively connected to one or a plurality of sensors 416 associated with each of a plurality of magnetic separators 434. For instance, system 400 may include a first location 426, a second location 428, and a third location 430, each of which may include one or more magnetic separators, magnetic separator types., and/or magnetic separator models. First location 426 may include a first magnetic separator 432*a*, and a second magnetic separator 432*b*. Both magnetic separators 432*a*, 432*b* may each be the same type of magnetic separator (e.g., the same design), but representing different model releases (e.g., magnetic separator 432*b* may be a subsequently released model having an improved gauss sensor, as one example). First location 426 may also include a second magnetic separator type 434 and a third magnetic separator type 436.

Second location 428, representative of a different facility than that of first location 426, may be either a different building within the same plot of land, a different state or country, or may be a different user that uses the same or similar magnetic separator as used by a user at second location 428. Third location 430, similarly, may be representative of yet a different facility, may be either a different building within the same plot of land, a different state or country, or may also be a different fabricator that uses the same or similar magnetic separators as used by other manufacturers. Second and third locations 428, 430 may also include the second magnetic separator type 434 and third magnetic separator type 436.

System 400 using processor 406 may provide operations that include displaying by way of user interface 414 statistics related to usage of each of magnetic separators 432*a*, 432*b*, 432*c*, 434, 436. That is, each of magnetic separators 432*a*, 432*b*, 432*c*, 434, 436 may have input thereto, as will be further described, via sensors 416. Sensors 416 may generally be proximity sensors, lasers, radar, or any type of sensor that may detect a presence of captured metal contaminants 222, 322 on magnets within separators 432*a*, 432*b*, 432*c*, 434, 436. Sensors 416 may also be Hall Effect sensors, but may in fact be any type of sensor that may be used to sense or measure a gauss field, which may provide information about a magnetic field and how it has changed with use of the respective magnetic separator. System 400 may also provide software, firmware, and sensor or other setting updates to any of magnetic separator 432*a*, 432*b*, 432*c*, 434, 436 at any of first, second, and third locations 426, 428, 430 via network 420 and transceiver 412. That is, user 401 may update magnetic separator settings having operational instructions for sensor settings, for instance, in device 402*a*, device 402*b*, and/or device 402*c*.

System 400 may include an overall network infrastructure through which any of devices 402, server 405, and database 422 may communicate, for example, to transfer information between any portion of system 400 using connections 424. In general, a network (e.g., system 400 or network 420) may be a collection of computing devices and other hardware to provide connections and carry communications. Devices 402 may include any computing device such as a mobile device, cellular phone, smartphone, smartwatch, activity tracker, tablet computer, next generation portable device, handheld computer, notebook, laptop, projector device, or virtual reality or augmented reality device. Devices 402 may include processor 406 that executes program 410. Device 402 may include memory 408 that stores magnetic separator model, setting, and other information, and program 410. Device 402 may include transceiver 412 that communicates information between any of devices 402, sensors 416, server 405, and database 422.

Server 405 may include any computing system. Server 405 may generate by processor 406, program 410 and store information by memory 406, e.g., information particular to each of magnetic separators 432*a*, 432*b*, 432*c*, 434, 436. Server 405 may communicatively connect with and transfer information with respect to devices 402, sensors 416, and database 422. Server 405 may be in continuous or periodic communication with devices 402, sensors 416, and database 422. Server 405 may include a local, remote, or cloud-based server or a combination thereof and may be in communication with and provide information (e.g., as part of memory 408 or database 422) to any or a combination of devices 402. Server 405 may further provide a web-based user interface (e.g., an internet portal) to be displayed by user interface 414. Server 405 may communicate the information with devices 402 using a notification including, for example automated phone call, short message service (SMS) or text message, e-mail, http link, web-based portal, or any other type of electronic communication. In addition, server 405 may be configured to store information as part of memory 408 or database 422. Server 405 may include a single or a plurality of centrally or geographically distributed servers 405. Server 405 may be configured to store and coordinate information with and between any of devices 402, and database 422. System 400, or any portion of system 400 such as magnetic separators 432*a*, 432*b*, 432*c*, 434, 436, may include one or more sensors 416 configured to receive sensor inputs and provide sensor outputs, e.g., including magnetic separator usage information associated with, for instance, frequency of cleaning operations that are conducted.

User interface 414 of devices 402 may include any user interface device, display device, or other hardware mechanism that connects to a display or supports user interfaces to communicate and present magnetic separator information throughout the system 400. User interface 414 may include any input or output device to facilitate receipt or presentation of information (magnetic separator operation information) in audio or visual form, or a combination thereof. Examples of a display may include, without limitation, a touchscreen, cathode ray tube display, light-emitting diode display, electroluminescent display, electronic paper, plasma display panel, liquid crystal display, high-performance addressing display, thin-film transistor display, organic light-emitting diode display, surface-conduction electron-emitter display, laser TV, carbon nanotubes, quantum dot display, interferometric modulator display, projector device, and the like. User interface 414 may present information to any user of devices 402.

Connections 424 may be any wired or wireless connections between two or more endpoints (e.g., devices or systems), for example, to facilitate transfer of magnetic separator information, to facilitate upgradeable enhancements to magnetic separator, such as wirelessly or via wired connections. Connection magnetic separator may include a local area network, for example, to communicatively connect the devices 402 with network 420. Connection 424 may include a wide area network connection, for example, to communicatively connect server 405 with network 420. Connection 424 may include a wireless connection, e.g., radiofrequency (RF), near field communication (NFC), Bluetooth communication, WIFI, or a wired connection, for example, to communicatively connect the devices 402, and sensors 416.

Magnetic separators 432*a*, 432*b*, 432*c*, 434, 436 may thereby be operated to include sensor settings or cleaning settings, as examples. According to the disclosure, data is heuristically obtained for, for instance, a given magnetic separator design. Best practices are employed based on experience obtained in some locations or with one magnetic separator, as examples, and applied to other magnetic separators at other locations. Statistical data is accumulated in, for instance, database 422, and best practices from the heuristic data are accumulated, analyzed, and optimized in order that settings may be collectively improved based on what is learned from other applications, locations, etc. For instance, a first location may operate several magnetic separators, and even several models of magnetic separators. Data may thereby be accumulated in database 422, analyzed, and optimized such that settings may be refined or revised for use at, for instance, a second location.

Any portion of system 400, e.g., devices 402 and server 405, may include a computing system and/or device that includes processor 406 and memory 408. Computing systems and/or devices generally include computer-executable instructions, where the instructions may define operations and may be executable by one or more devices such as those listed herein. Computer-executable instructions may be compiled or interpreted from computer programs created using a variety of programming languages and/or technologies, including, without limitation, and either alone or in combination, Java language, C, C++, Visual Basic, Java Script, Perl, SQL, PL/SQL, Shell Scripts, Unity language, etc. System 400, e.g., devices 402 and server 405 may take many different forms and include multiple and/or alternate components and facilities, as illustrated in the Figures. While exemplary systems, devices, modules, and sub-modules are shown in the Figures, the exemplary components illustrated in the Figures are not intended to be limiting. Indeed, additional or alternative components and/or implementations may be used, and thus the above communication operation examples should not be construed as limiting.

In general, computing systems and/or devices (e.g., devices 402 and server 405) may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, California), the AIX UNIX operating system distributed by International Business Machines of Armonk, N.Y., the Linux operating system, the Mac OS X and iOS operating systems distributed by Apple Inc. of Cupertino, Calif., the BlackBerry OS distributed by Research In Motion of Waterloo, Canada, and the Android operating system developed by the Open Handset Alliance. Examples of computing systems and/or devices such as devices 402, and server 405 may include, without limitation, mobile devices, cellular phones, smart-phones, super-phones, next generation portable devices, mobile printers, handheld or desktop computers, notebooks, laptops, tablets, wearables, virtual or augmented reality devices, secure voice communication equipment, networking hardware, computer workstations, or any other computing system and/or device.

Further, processors such as processor 406 receive instructions from memories such as memory 408 or database 422 and execute the instructions to provide the operations herein, thereby performing one or more processes, including one or more of the processes described herein. Such instructions and other guidance information may be stored and transmitted using a variety of computer-readable mediums (e.g., memory 408 or database 422). Processors such as processor 406 may include any computer hardware or combination of computer hardware that is configured to accomplish the purpose of the devices, systems, operations, and processes described herein. For example, processor 406 may be any one of, but not limited to single, dual, triple, or quad core processors (on one single chip), graphics processing units, and visual processing hardware.

A memory such as memory 408 or database 422 may include, in general, any computer-readable medium (also referred to as a processor-readable medium) that may include any non-transitory (e.g., tangible) medium that participates in providing guidance information or instructions that may be read by a computer (e.g., by the processors 406 of the devices 402 and server 405). Such a medium may take many forms, including, but not limited to, non-volatile media and volatile media. Non-volatile media may include, for example, optical or magnetic disks and other persistent memory. Volatile media may include, for example, dynamic random-access memory (DRAM), which typically constitutes a main memory. Such instructions may be transmitted by one or more transmission media, including radio waves, metal wire, fiber optics, and the like, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Further, databases, data repositories or other guidance information stores (e.g., memory 408 and database 422) described herein may generally include various kinds of mechanisms for storing, providing, accessing, and retrieving various kinds of guidance information, including a hierarchical database, a set of files in a file system, an application database in a proprietary format, a relational database management system (RDBMS), etc. Each such guidance information store may generally be included within (e.g., memory 408) or external (e.g., database 422) to a computing system and/or device (e.g., devices 402 and server 405) employing a computer operating system such as one of those mentioned above, and/or accessed via a network (e.g., system 400 or network 420) or connection in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above. Memory 408 and database 422 may be connected to or part of any portion of system 400.

When introducing elements of various embodiments of the disclosed materials, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

While the preceding discussion is generally provided in the context of medical imaging, it should be appreciated that the present techniques are not limited to such medical contexts. The provision of examples and explanations in such a medical context is to facilitate explanation by providing instances of implementations and applications. The disclosed approaches may also be utilized in other contexts, such as the non-destructive inspection of manufactured parts or goods (i.e., quality control or quality review applications), and/or the non-invasive inspection or imaging techniques.

While the disclosed materials have been described in detail in connection with only a limited number of embodiments, it should be readily understood that the embodiments are not limited to such disclosed materials. Rather, that disclosed can be modified to incorporate any number of variations, alterations, substitutions or equivalent arrangements not heretofore described, but which are commensurate with the spirit and scope of the disclosed materials. Additionally, while various embodiments have been described, it is to be understood that disclosed aspects may include only some of the described embodiments. Accordingly, that disclosed is not to be seen as limited by the foregoing description, but is only limited by the scope of the appended claims.

What is claimed is:

1. A system, comprising:

a first magnetic separator including:

one or more magnets providing a magnetic field within a product flow path such that metal contaminants of a material passable through the product flow path are attracted to and captured on the one or more magnets accumulating thereon via the magnetic field; and a first sensor to detect a level of the metal contaminants accumulated on the one or more magnets; and a first controller configured to:

receive a signal from the first sensor, the signal indicating the level of the metal contaminants accumulated on the one or more magnets; and send an instruction based on the signal received.

2. The system of claim 1, wherein the one or more magnets are permanent magnets.

3. The system of claim 1, wherein the one or more magnets are electromagnets, and the first controller is configured to apply a first electric current to the one or more magnets.

4. The system of claim 3, wherein the first controller is configured to apply a second electric current to the one or more magnets based on the signal received from the first sensor, and wherein the second electric current is greater than the first electric current.

5. The system of claim 1, wherein:

a strength of the magnetic field decreases as the level of the metal contaminants accumulated on the one or more magnets increases;

the first sensor detects the strength of the magnetic field; and the first controller is further configured to detect a change in the strength of the magnetic field via comparing the detected strength of the magnetic field to a predetermined value.

6. The system of claim 5, wherein the first sensor is a Hall Effect Sensor.

7. The system of claim 1, wherein the instruction is sent to a user indicating that the first magnetic separator requires cleaning.

8. The system of claim 1, wherein the first magnetic separator further includes an automatic cleaning device, and the instruction is sent to the automatic cleaning device for automatic cleaning of the one or more magnets.

9. The system of claim 1, wherein the first sensor is arranged proximate a working air gap extending between two of the one or more magnets.

10. The system of claim 1, further comprising a hardware processor and a database communicatively connected to the first controller via a network, wherein the first controller is configured to send the instruction to the hardware processor.

11. The system of claim 10, further comprising a second magnetic separator including a second controller connected to the hardware processor and the database via the network, wherein the first magnetic separator is arranged at a first location and the second magnetic separator is arranged at a second location different than the first location.

12. The system of claim 1, further comprising a housing defining the product flow path.

13. A method of operating a magnetic separator, comprising:

generating a magnetic field in a product flow path using one or more magnets, the product flow path defined by one of a chute and a housing;

passing a material including metal contaminants through the product flow path;

extracting the metal contaminants from the material via attracting the metal contaminants and accumulating the metal contaminants on the one or more magnets with the magnetic field;

detecting a level of the metal contaminants accumulated on the one or more magnets; and sending an instruction based on the detected level of the metal contaminants accumulated on the one or more magnets.

14. The method of claim 13, wherein detecting the level of the metal contaminants accumulated on the one or more magnets includes detecting a strength of the magnetic field, and wherein the instruction sent is based on the detected strength of the magnetic field compared to a predetermined value.

15. The method of claim 14, wherein at least one of the one or more magnets is an electromagnet, and wherein generating the magnetic field includes supplying an electric current to the electromagnet.

16. The method of claim 15, further comprising increasing the strength of the magnetic field via increasing the electric current supplied to the electromagnet when a second instruction is received, and wherein sending the instruction includes sending the second instruction when the detected strength of the magnetic field is below the predetermined value and the electromagnet is below an operating maximum.

17. The method of claim 13, wherein sending the instruction includes sending a notification to a user that the one or more magnets require cleaning.

18. The method of claim 13, wherein sending the instruction includes sending the instruction to an automatic cleaning device, the method further comprising removing the metal contaminants accumulated on the one or more magnets via the automatic cleaning device.

19. A magnetic separator, comprising:

a first housing defining a product flow path through which a material is flowable;

magnets providing a magnetic field within the product flow path such that metal contaminants of the material are attracted to the magnets, extracted from the material, and accumulated on the magnets via the magnetic field as the material flows past the magnets;

a sensor configured to detect a level of the metal contaminants accumulated on the magnets; and a controller configured to:

receive a signal from the sensor, the signal indicating the level of the metal contaminants accumulated on the magnets; and send an instruction based on the signal received.

20. The magnetic separator of claim 19, wherein the magnets are electromagnets, and the controller is configured to:

apply a first electric current to the magnets; and apply a second current, different from the first current, to the magnets based on the signal received from the sensor.

21. The magnetic separator of claim 19, wherein the instruction is sent to a user indicating that the magnets require cleaning.

22. The magnetic separator of claim 19, further comprising an automatic cleaning device, and the instruction is sent to the automatic cleaning device which initiates an automatic cleaning of the magnets.

23. The magnetic separator of claim 17, wherein the magnets are plate magnets extending parallel to one another, each of the plate magnets having one of a north pole and a south pole in a central region and the other of the one of the north pole and the south pole in a perimeter region.

24. The method of claim 13, wherein sending the instruction includes sending the instruction to a hardware processor and a database communicatively connected to the first controller via a network, the method further comprising updating operating settings of the magnetic separator based on data accumulated and stored in the database from at least one other magnetic separator.

25. The method of claim 17, further comprising manually removing the metal contaminants accumulated on the one or more magnets after the notification is received.

26. The method of claim 18, wherein removing the metal contaminants accumulated on the one or more magnets via the automatic cleaning device includes mechanically scrubbing the one or more magnets with the automatic cleaning device.

* * * * *